US005444442A

United States Patent [19]

Sadakata et al.

[11] Patent Number: 5,444,442

[45] Date of Patent: Aug. 22, 1995

[54] METHOD FOR PREDICTING TRAFFIC SPACE MEAN SPEED AND TRAFFIC FLOW RATE, AND METHOD AND APPARATUS FOR CONTROLLING ISOLATED TRAFFIC LIGHT SIGNALING SYSTEM THROUGH PREDICTED TRAFFIC FLOW RATE

[75] Inventors: Mareo Sadakata, Yokohama; Yoichiro Iwasaki, Kumamoto; Yoshiharu Yano, Yokohama; Masakazu Toyama, Tokyo, all of Japan

[73] Assignees: Matsushita Electric Industrial Co., Ltd., Osaka; Tokai University Educational System, Tokyo, both of Japan

[21] Appl. No.: 143,119

[22] Filed: Oct. 29, 1993

[30] Foreign Application Priority Data

Nov. 5, 1992 [JP] Japan ..... 4-295939

[51] Int. Cl.[6] ..... G08G 1/07

[52] U.S. Cl. ..... 340/916; 340/934; 340/936; 340/937; 364/436; 364/437; 364/438

[58] Field of Search ..... 340/934, 936, 937, 942; 364/436, 437, 438; 358/125

[56] References Cited

U.S. PATENT DOCUMENTS 4,390,951 6/1983 Marcy ..... 340/936
5,283,573 2/1994 Takatou et al. ..... 340/934

FOREIGN PATENT DOCUMENTS 1281598A 11/1989 Japan .
3273400A 12/1991 Japan .

OTHER PUBLICATIONS

Yoichiro Iwasaki et al.; Operational Research: 90, "An Informational Quantification by Entropy for Spatial Road Traffic Flow"; Jun. 25–29, 1990; pp. 379–392.

*Primary Examiner*—John K. Peng
*Assistant Examiner*—Daryl C. Pope
*Attorney, Agent, or Firm*—Stevens, Davis, Miller & Mosher

[57] ABSTRACT

A method for predicting a traffic flow rate at a point on a road to control a traffic light signaling system measures a traffic density on the road to predict a traffic flow rate by utilizing the fact that a velocity of a vehicle on the road is restricted by an interval between successive vehicles, since the traffic density is locally increased when the vehicle interval is not uniform and therefore the spatial mean speed is lowered. This method offers higher accuracy by utilizing a correction coefficient obtained from an actual vehicle distribution, for instance, a coefficient derived from entropy. An apparatus for controlling a traffic light signaling system installed on a point of a road by utilizing this predicting method, thereby smoothing a traffic condition, includes video cameras for picking up images of a traffic condition at an upper stream of an intersection, an A/D converter for converting an analog video output signal into a digital video signal, two sets of image memories for storing digital image data about two scenes imaged by the video cameras at a proper time interval, an image processing unit for extracting moving objects from the images, a data process/control unit for calculating a total number of vehicles within a predetermined area and each space headway, whereby a vehicle distribution pattern is recognized an a correction coefficient is calculated, and an input/output unit for interfacing with the traffic light signaling system installed on the road.

9 Claims, 4 Drawing Sheets

METHOD FOR PREDICTING TRAFFIC SPACE MEAN SPEED AND TRAFFIC FLOW RATE, AND METHOD AND APPARATUS FOR CONTROLLING ISOLATED TRAFFIC LIGHT SIGNALING SYSTEM THROUGH PREDICTED TRAFFIC FLOW RATE

BACKGROUND OF THE INVENTION

1. Field of the Invention

The present invention relates to a method for predicting a traffic space mean speed and a traffic flow rate from a traffic density on a road, and further to a method and an apparatus for controlling a traffic light signaling system located at an intersection based upon the predicted traffic flow rate.

2. Description of the Related Art

Conventionally, to either maintain a smooth traffic condition, or construct a proper traffic system, traveling conditions of vehicles are measured to predict a traffic flow rate of the vehicles traveled on a road. Velocities of the vehicles traveling on the road are restricted by intervals among the successively traveling vehicles. As a consequence, an average velocity of a group of traveling vehicles may be predicted from a traffic density of the traveling vehicle group.

The conventional traffic flow rate predicting method is established under condition that the following relationship is satisfied.

That is, assuming now that a traffic flow rate is "q", a space mean speed is "v", and a traffic density is "k", a basic equation (1) can be satisfied:

$$q=kv \tag{1}$$

It should be understood that a traffic space mean speed implies an arithmetic average value for velocities of vehicles located within a predetermined section on a road at a certain time instant, whereas a traffic density implies a quantity of vehicles present on a road in a unit length thereof at a certain time instant.

A relationship between the space mean speed "v" and the traffic density "k" is represented as a k-v curve in FIG. 4.

In FIG. 4, an abscissa indicates the traffic density "k" and an ordinate denotes the space mean speed "v". If the intervals among the successively traveling vehicles are narrow and the traffic density becomes high, then the vehicles could travel only in low speeds, resulting in a traffic jam. Eventually, the traffic density is brought into a jam density, so that a vehicle stream cannot be moved. Conversely, if the intervals among the successively traveling vehicles are wide and the traffic density becomes low, then a vehicle stream can be moved at high speeds. Eventually, each of these vehicles can freely travel at a velocity determined by the road conditions.

A crosspoint "kj" between the k-v curve and the abscissa represents a jam density, whereas a crosspoint "vf" between the k-v curve and the ordinate represents a free speed. Both of a curve pattern and these crosspoints may be determined based upon the road conditions and the like.

As a typical k-v relational expression fv(k), the following equation (2) is known. The equation (2) represents such a case that the traffic density "k" and the space mean speed "v" can satisfy a linear relationship. As explained above, when the space mean speed "v" is expressed by the traffic density "k", the traffic flow rate "q" becomes the function of only the traffic density "k", and therefore becomes a k-q curve as indicated in FIG. 5. This implies that the traffic flow rate may be predicted from the traffic density.

$$v=vf(1-k/kj) \tag{2}$$

In a conventional control method for isolated traffic signals which are not intervened from other signals, a time gap control method for predicting traffic conditions based on time headways has been widely utilized that when the time headway is below than the threshold value, the green time is prolonged, and when the time headway exceeds the threshold value, a decision can be made that the saturation flow has passed through, whereby the green time is ceased.

A saturation flow implies such a traffic flow that vehicles travel while keeping a substantially minimum constant interval, and thus becomes a maximum flow rate of the vehicles at an incoming passage of a certain intersection. For instance, such a constant traffic flow corresponds to this saturation flow that if a vehicle stream is stopped at a traffic light, after turning-ON of the green light is commenced and approximately three vehicles located from the top position have passed, the subsequent vehicles are advanced.

FIG. 5 represents a relationship between a traffic flow rate and a traffic density in the conventional traffic flow rate predicting method. FIG. 5 indicates such a condition that a measurement is carried out for a unit time under constant traveling flow where no influence caused by the signaling control is given.

In FIG. 5, under a light traffic condition from traffic density of 0 to traffic density of "kc" at which the maximum traffic flow rate appears, when a total number of vehicles present within the section increases, the traffic flow rate also increases. However, when the traffic density exceeds "kc" and is brought into a heavy traffic condition, a smoothness of the vehicle traveling (average speed) is lowered and eventually, when the traffic density becomes "kj", no vehicle can travel. Accordingly, other than "kc", there are two traffic density conditions with respect to a certain traffic flow rate.

In the short time measurement of the road traffic flow where the influence caused by the traffic signal control is given, there is observed a large number of different vehicle distribution patterns even in the same traffic density. When too many vehicle groups are formed, the short time traffic flow rate approaches 0 irrespective of to the traffic density. As a consequence, the short-time traffic flow rate of the road traffic is present within an area surrounded by the curve and the abscissa shown in FIG. 5. This has been apparently proved by the actual traffic flow measurements obtained by the Applicant's experiments.

As described above, in accordance with the conventional traffic flow rate predicting method, there is such a problem that although the traffic flow rate obtained from the traffic density should be present on the "k-q" curve of FIG. 5, a plurality of actual short-time traffic flow rates would be present in an area surrounded by the X axis and the curve, which improperly reflects the actual traffic flow rate.

Also, in the conventional isolated traffic signal control method, there is another problem that since a certain time is required to directly measure the traffic flow rate, this measuring time may cause a delay control.

Further, in the above-explained conventional isolated traffic signal control method, since fluctuation in the time headway becomes large, depending on the different combinations of the preceding and succeeding vehicles, it is rather difficult to set the threshold values of the time headway. If a small threshold value is set, then a saturation flow would not pass through the cross-section thoroughly. Conversely, if a very large threshold value is set, then even when the saturation flow is ended, the green light signal would be continuously outputted vainly.

Then, in the above-explained conventional isolated traffic signal control method, the initial green time is previously set to a preselected constant green time, and the fixed initial green time is outputted even when no vehicle is located within the fixed initial green time. As a result, there is another problem that waste time happens to occur.

Moreover, in accordance with the conventional isolated traffic signal control method, since the input information used in the traffic signal control corresponds to a condition amount derived from the local data (quantity of passing vehicle and sensing pulse width), it is practically difficult to entirely grasp complex traffic flows.

JP-A-1-281598 issued to Soga et al describes that a recognition apparatus for recognizing the license plate of the vehicle traveling on the road is commonly utilized as the traffic-flow measurement apparatus by operating the switching unit. In this conventional recognition apparatus of Soga et al, when the traffic flow is measured, the viewing angle of the ITV camera used to pick up the image of the license plate is selected to be a large viewing angle so as to pick up image of the road. After the road image is inputted, the vehicle images are independently extracted one by one by way of the image processing techniques, thereby calculating the velocities, sorts, and quantity of passing vehicles. Although this conventional apparatus does not clearly disclose the concrete processing method for calculating the velocities and the like, since this apparatus utilizes such a processing technique for recognizing the numeral data indicated on the license plate, it seems that a very complex arithmetic calculation has been employed.

Marcy discloses a monitoring system in U.S. Pat. No. 4,390,951 which measures both of the mean overall speed of vehicles passing over the surveyed road section and the combined length of vehicles simultaneously present on the surveyed road, obtains an encumbrance parameter by diving the combined length by the mean overall speed to be recognized as a degree of loading of the road, and then controls the traffic lights corresponding to the traffic flow rate predicted from this encumbrance parameter. The monitoring system of Marcy must actually measure the velocities and the lengths of the respective vehicles passing the entrance and the exit of a predetermined road area, namely must measure a large number of elements, resulting in a complex monitoring system.

JP-A-3-273,400 by Naito discloses a method for measuring traveling conditions of traffic by employing a CCD camera by monitoring one typical vehicle selected from the traffic in order to predict the traffic conditions. This measuring system is to avoid such a difficulty in processing the image data for tracking a preselected vehicle without confusion for image recognition purposes, and is therefore to grasp the traveling conditions of a single vehicle in such a manner that a large quantity of measurement sampling areas are provided on the road monitored by the CCD camera, and the passages of the vehicles through these sampling areas are sequentially detected. Accordingly, this measuring system requires the mechanism to actually measure the velocities of the vehicles.

SUMMARY OF THE INVENTION

The present invention is to solve the above-described conventional problems, and has an object to provide a method for predicting a traffic flow rate properly corresponding to the actual traffic flow rate, and as another object to provide an isolated traffic signal control method for controlling a traffic light signaling system based upon the predicted traffic flow rate.

Also, to achieve the above-mentioned objects, in accordance with another aspect of the present invention, the traffic light signaling system is controlled based upon such a traffic flow rate predicted from a spatial vehicle distribution pattern which has been produced by measuring traffic flow conditions on a road space at a certain instant.

Furthermore, to achieve the above-explained objects, in accordance with a further aspect of the present invention, a trend of vehicles located in an upper stream from an intersection is imaged by video cameras in a bird's eye manner, the resultant image data are processed by an image processing apparatus to obtain a spatial distribution pattern of vehicles present in the measurement section, and a traffic flow rate for several seconds is predicted from this spatial vehicle distribution pattern, whereby a control signal is transmitted to the traffic light signaling system.

According to the present invention, the mean speed and the traffic flow rate of the road traffic flow within the traffic measurement section, which are varied from time to time as in urban areas, can be predicted in high precision by employing the spatial information without any time delays. That is, the space mean speed indicative of the k-v relational expression is set to the upper limit value at this traffic density, and this upper limit value is multiplied by the correction coefficient ranging from 0 to 1 in response to the group formation states of the vehicles, whereby both of the space mean speed and the traffic flow rate can be predicted in high precision.

Also, according to the present invention, the jammed or saturated traffic flow may be readily predicted based upon the spatial vehicle distribution. The green times for the traffic lights can be distributed under optimum condition. In addition, since the initial green time which was conventionally constant, may be varied in accordance with the traffic flows, an excessive initial green time may be eliminated.

Moreover, in accordance with the present invention, the spatial vehicle distribution pattern can be obtained by employing the video cameras and the simple image processing apparatus. Based upon this distribution pattern, the proper control signal without any waste time may be transmitted to the traffic light signaling system.

BRIEF DESCRIPTION OF THE DRAWINGS

The present invention may be understood by reading the detailed descriptions in conjunction with the accompanying drawings, in which.

DESCRIPTION OF THE PREFERRED EMBODIMENTS

Figure 1:
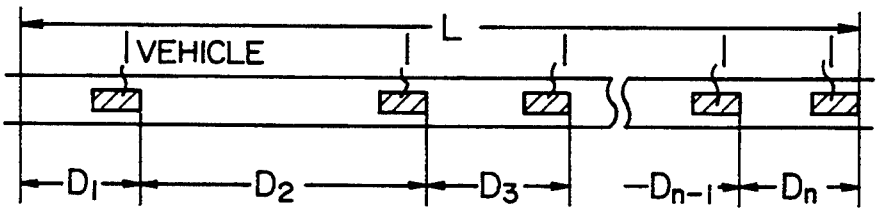
FIG. 1 is a schematic diagram for representing section information of a vehicle distribution according to a first embodiment of the present invention.

Referring now to the drawings, various embodiments of the present invention will be described.

FIRST EMBODIMENT

A method for predicting space mean speed and a traffic flow rate according to a first embodiment of the present invention will now be explained. In accordance with this first embodiment, a correction coefficient is constructed based upon a parameter referred to "entropy" in order to predict a traffic flow rate.

FIG. 1 schematically shows section information of a vehicle distribution. In FIG. 1, reference numerals 1 indicate vehicles. Assuming now that "n" vehicles are present within a section L (meters) with a certain vehicle distribution at a certain time instant, and intervals among the "n" vehicles (space headway) are Di (meters) where symbol "i" is equal to 1, 2, 3, - - - , n, spatial vehicle entropy during the traffic measurement may be calculated by the following equation (3):

$$\begin{aligned} H &= -(D1/L)\mathrm{LOG}_2(D1/L) - (D2/L)\mathrm{LOG}_2(D2/L) = \\ &\quad \ldots -(Dn/L)\mathrm{LOG}_2(Dn/L) \\ &= -\sum_{i-1}^{n}(Di/L)\mathrm{LOG}_2(Di/L) \end{aligned} \tag{3}$$

Based on this equation (3), it is possible to express such a difference in traffic flow conditions by numerical values when the same number of vehicles are distributed in difference within the same traffic measuring region.

In other words, when all of the vehicles are arranged at an equi-interval (Di=L/n), the entropy of spatial vehicles becomes maximum based on the above-described equation (3), and this maximum entropy will be referred to "Hmax". Also, when the respective vehicles' intervals become minimum and "n" vehicles constitute a single vehicle group while no further vehicle is present within the traffic measuring region, the resultant entropy becomes minimum and this minimum entropy will be referred to "Hmin". Then, these entropy values Hmax and Hmin may be expressed by the below-mentioned equations (4) and (5), respectively:

$$\begin{aligned} Hmax &= -\sum_{i=1}^{n}(Di/L)\mathrm{LOG}_2(Di/L) \\ &= -\mathrm{LOG}_2(1/n) \\ &= \mathrm{LOG}_2 n \\ Hmin &= -((L - Dj(n-1))/L)\mathrm{LOG}_2((L - Dj(n-1))/L - \\ &\quad \sum_{i=1}^{n-1}(Dj/L)\mathrm{LOG}_2(Dj/L) \\ &= -((L - Dj(n-1))/L)\mathrm{LOG}_2 \\ &\quad ((L - Dj)(n-1))/L) - \\ &\quad (n-1)(Dj/L)\mathrm{LOG}_2(Dj/L) \end{aligned} \tag{5}$$

Now, a calculation is made by dividing a difference between the entropy condition H and the minimum condition Hmin as a numerator by a difference between the maximum condition Hmax and the minimum condition Hmin as a denominator. Thus, the calculated coefficient (H-Hmin)/(Hmax-Hmin) ranges from 0 to 1. In case of the normal traffic flow, since the entropy condition H becomes Hmax, this coefficient becomes 1. In case of the minimum space headway, all of the vehicles on the road become a single group and thus the entropy condition H becomes Hmin, so that the resultant coefficient become 0 and the vehicle speed becomes 0. As a consequence, this coefficient indicates a degree of smoothness of the traffic flow at the same density, and may be used as such a correction coefficient that the traffic density is coincident with the actual traffic flow. Accordingly, as represented in equation (6), this coefficient is multiplied by the (k-v) relational formula fv(k), thereby predicting a space mean speed:

$$Vse = fv(k) \bullet (H - Hmin)/(Hmax - Hmin) \tag{6}$$

where symbol "Vse" denotes a predicted value for the space mean speed. It should be noted that a relative coefficient between the actually measured value in the straight lanes of the crossroads and the space mean speed predicted by the equation (6) could reach 0.971. Using the equation (1), the predicted space mean speed Vse is multiplied by the traffic density k, thereby predicting a traffic flow rate, as shown in equation (7):

$$Qse = Vse \bullet k \tag{7}$$

where symbol Qse indicates a predicted value of the traffic flow rate.

In accordance with the traffic flow rate predicting method of the first embodiment of the present invention, the traffic density is first calculated, the correction coefficient is calculated based on the vehicle distribution's entropy representative of the vehicle distribution pattern by utilizing the equation (6), and then the traffic density is corrected by way of the equation (7) in order to predict the actual traffic flowrate. Thus, the traffic flow rate predicting method predicts the traffic flowrate only by obtaining the vehicle distribution at a certain time instant within a measurement section.

As previously described, according to the first embodiment, both of the mean velocities and the traffic flow rates within the traffic section of the road, which are varied time to time, can be predicted at high precision. In particular, the above-described isolated traffic signal control method with use of entropy is optimized as a method for instantaneously predicting a traffic flow rate from a vehicle distribution condition of a traffic section with a length of approximately 70 meters.

SECOND EMBODIMENT

Figure 2:
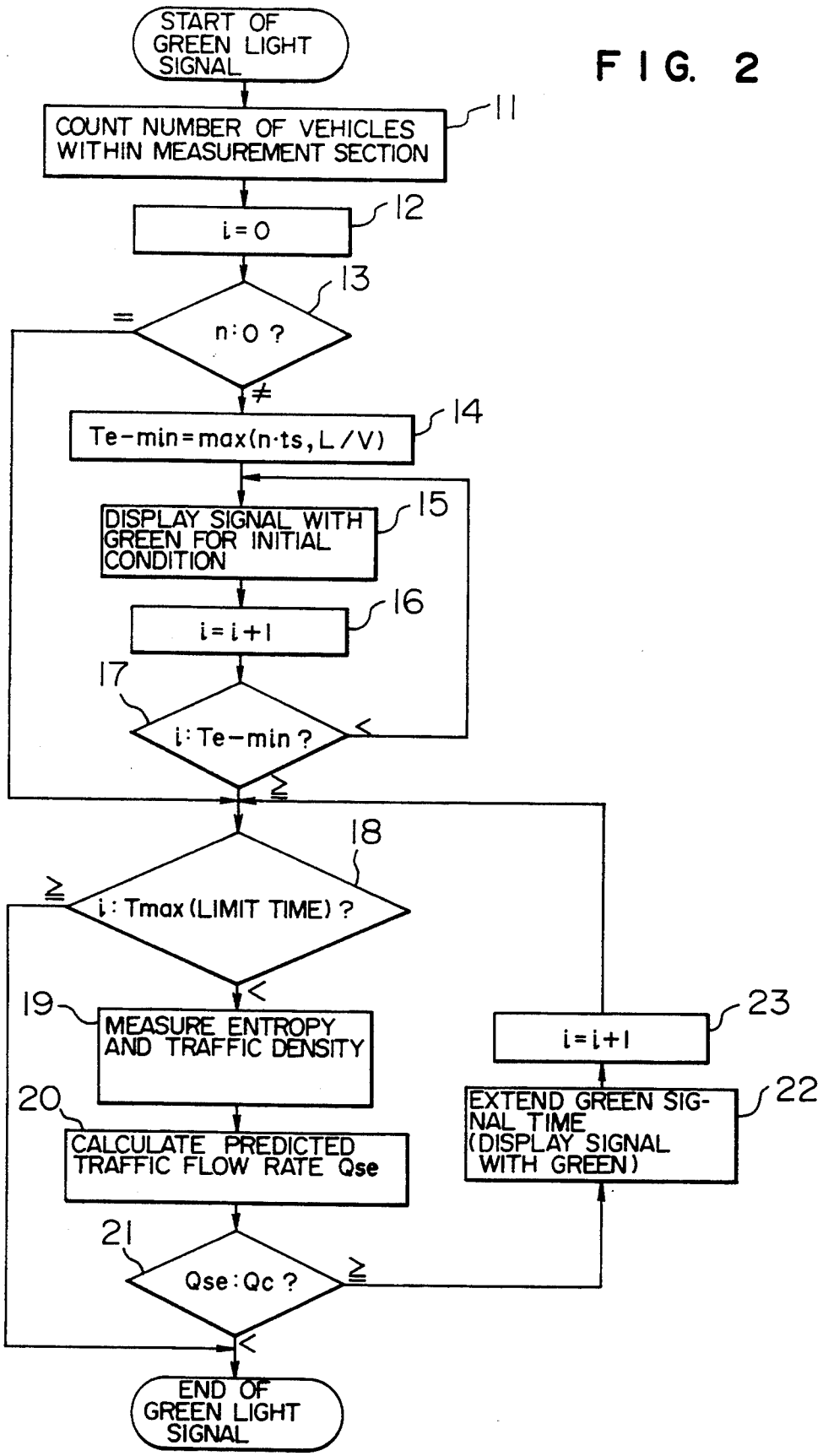
FIG. 2 is a flow chart for showing an isolated traffic signal control method according to a second embodiment of the present invention.

Then, an isolated traffic signal control method according to a second embodiment of the present invention will now be explained with reference to an algorithm shown in FIG. 2. First, a total number "n" of vehicles located within a traffic measurement section is obtained (step 11). A judgement is made as to whether the vehicles are present or not in the measurement area (steps 12 and 13). If the vehicles are present, then initial green time Te-min is calculated by equation (8) (step 14), and thus green signal is transmitted during the initial green time (steps 15, 16, 17):

$$Te-min=max\ (n \bullet ts,\ L/V) \tag{8}$$

where symbol "ts" denotes mean time headway in saturated traffic flow, and symbol "V" indicates mean speed in saturated traffic flow.

A time period required to let the last vehicle of "n" queuing vehicles pass through the cross-section is calculated from n×ts. Also, a time period when the vehicle located at the last end of the traffic measurement section runs through the cross-section is calculated from L/V. As a consequence, the larger value in the above time periods is set as the initial green time based only on the information about the quantity of vehicles. When there are only a small number of vehicles in the traffic measurement section, a comparison of n•ts and L/V is preferably introduced into the procedures in order to prevent the initial green time from being so short that all the approaching vehicles cannot pass. As described above, based on the equation (8), it is set the minimum time period required for either the queuing vehicle or the approaching vehicles which are present when the green time is commence to pass through. Accordingly, it is possible to prevent an increase of waste time caused by the unnecessarily lengthy initial green time.

Once the initial green time is finished, the entropy and the density are iteratively calculated until a predetermined maximum limit green time Tmax (step 18) based on the equations (3) and (4) used in the first embodiment (step 19). And also, a predicted traffic flow rate Qse is subsequently obtained from the equations (6) and (7) (step 20). Then, a comparison is made between the predicted traffic flow rate Qse and a threshold value Qc (step 21). If the predicted traffic flow rate is smaller than the threshold value, then the green traffic light is alternated by other traffic lights. Conversely, if the predicted traffic flow rate is greater than the threshold value, then the green time is extended (steps 22, 23). This process operation is continued until the maximum green time limit Tmax (step 18). When the time exceeds the maximum green time limit Tmax, the green light signal process is ended.

As previously explained in detail, in accordance with the second embodiment, there is such a merit that the optimum green times of the traffic signal controller can be properly distributed based upon the predicted value of the jammed traffic flow derived from the spatial vehicle distribution. Also, there is another advantage that the initial green time which was originally constant, can be varied in accordance with the traffic flows based on the equation (8).

THIRD EMBODIMENT

Figure 3:
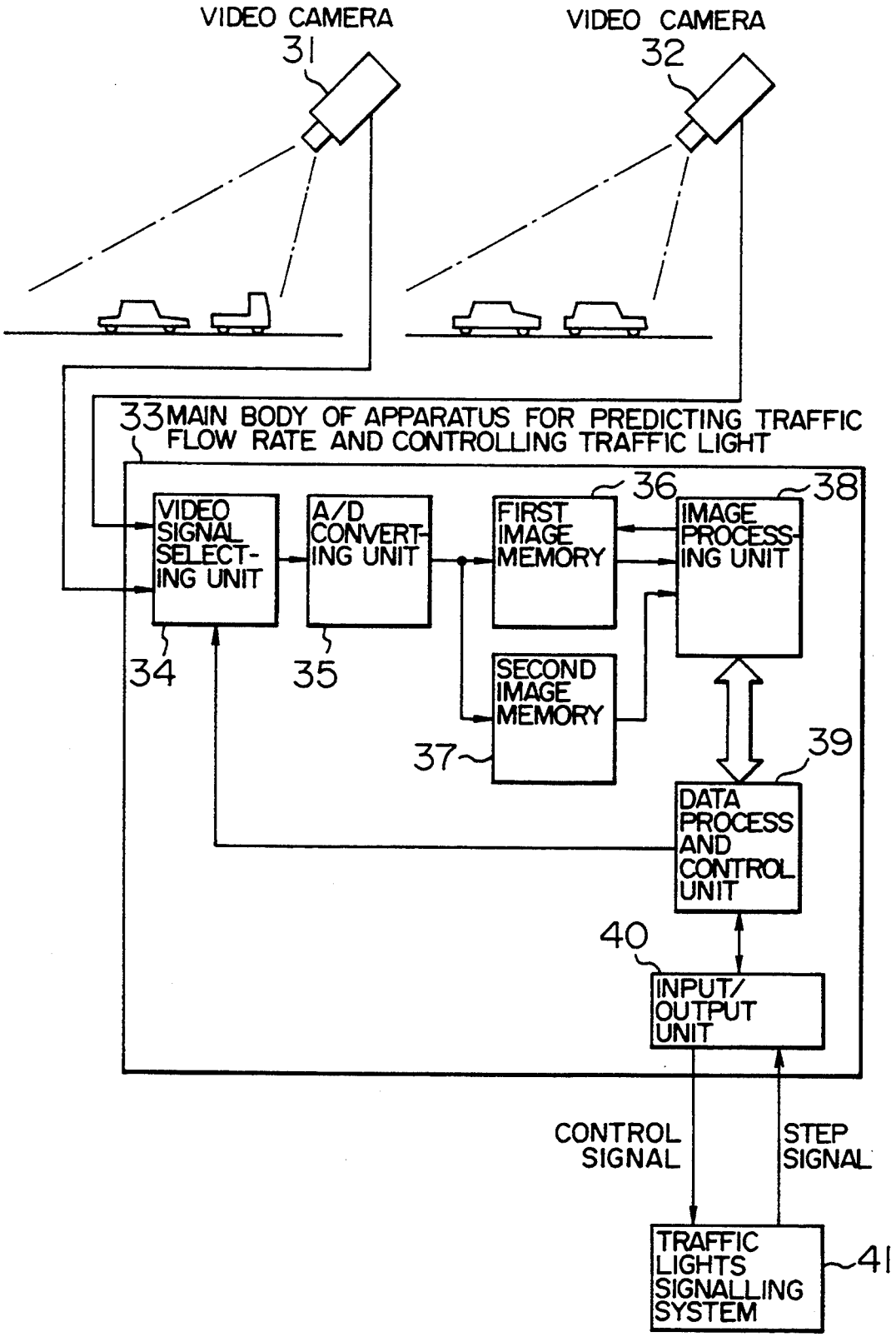
FIG. 3 is a schematic block diagram for indicating an arrangement of an apparatus for traffic flow rate prediction and traffic light control according to a third embodiment of the present invention.
Figure 4:
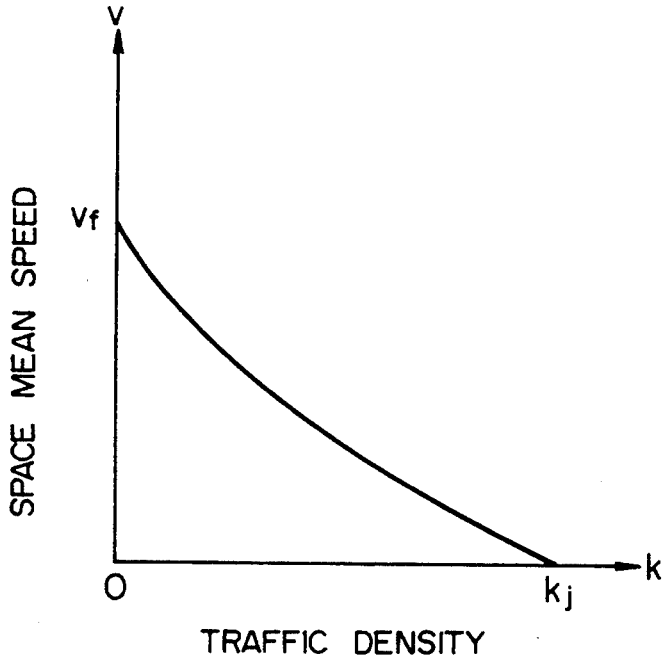
FIG. 4 PRIOR ART
FIG. 4 is a graphic representation of a relationship between space mean speed and traffic density in the conventional traffic flow rate prediction method of the prior art.
Figure 5:
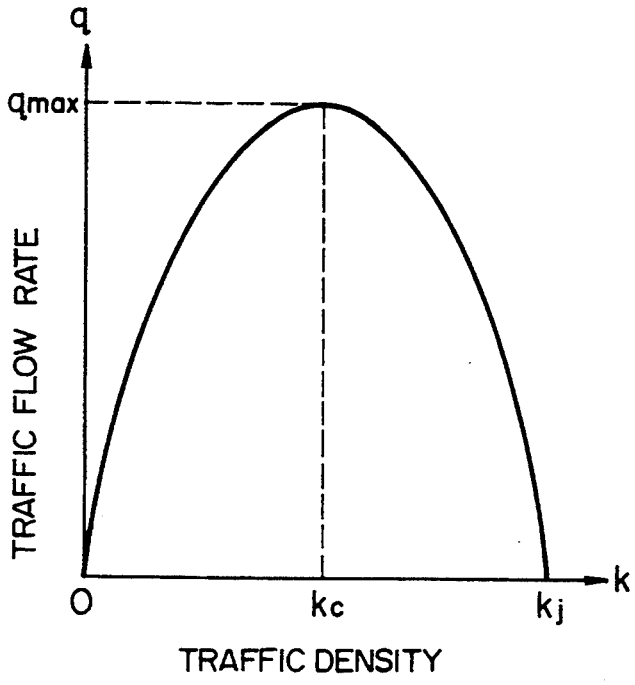
FIG. 5 PRIOR ART
FIG. 5 is a graphic representation of a relationship between traffic flow rate and traffic density in the conventional traffic flow rate prediction method of the prior art.

In FIG. 3, there is shown an apparatus for predicting a traffic flow rate and for controlling traffic lights, according to a third embodiment of the present invention.

In FIG. 3, reference numerals 31 and 32 denote video cameras respectively furnished at roads intersecting each other for imaging a trend of vehicle's groups at an upper stream of an intersection in a bird's eye viewing form. Reference numeral 33 indicates the main body of the apparatus, reference numeral 34 shows a video signal selecting unit, reference numeral 35 represents an A/D converting unit. Further, reference numeral 36 indicates a first image memory for input image 1, reference numeral 37 shows a second image memory for input image 2, reference numeral 38 denotes an image processing unit, reference numeral 39 represents a data process and control unit, reference numeral 40 denotes an input/output unit, and reference numeral 41 denotes a traffic light signaling system.

Operation of the above-explained third embodiment will now be described. In the third embodiment, the video information obtained by imaging a trend of a vehicle group at an upper stream of the intersection with employment of the video camera 31 or 32, is transmitted to the main body 33 of the apparatus for predicting traffic flow rate and controlling traffic lights.

In the main body 33, conditions of step signals indicating green, red and yellow lights of the traffic light and its complemental traffic light located at the crossroad are acquired via the input/output unit 40 for judgement purposes. Then, the video signal selecting unit 34 selects either the video signal from the video camera 31, or the video signal from the video camera 32, and the A/D converting unit 35 converts the selected video signal into digital video data. Subsequently, the digital video data about two images (namely, input image 1 and input image 2) which have been picked up in a predetermined interval, are stored into the first image memory 36 and the second image memory 37. The image processing unit 38 reads out the digital video data from these image memories 36 and 37, and subtracts one of these digital video data for two images from the other (frame subtraction). As a result of this frame subtraction, only a moving object located in the traffic measurement region can be extracted (symbols painted on the crossroads and others are erased). A major merit of this frame subtraction may withstand an instantaneous variation in brightness, so that the traffic flow measurement by utilizing such a frame subtraction is suitable for imaging such an outdoor place where brightness is widely changed. Although this frame subtraction method cannot extract a stopping object as a demerit, since the traffic flow rates of such conditions that no vehicle is present, and the vehicles are stopped within the entire traffic measurement region are equal to 0, there is no problem in the traffic flow measurement. The image-processed video data by the image processing unit 38 is written into the first image memory 36.

Next, the image-processed digital video data is furnished to the data process/control unit 39 so as to measure the positions of all the moving objects within the traffic flow measurement section measured from the intersection, which have been extracted by way of the frame subtraction, thereby obtaining a total number of these vehicles and also each of space headway. Furthermore, based on the equations (3), (4) and (5) employed in the first embodiment, the traffic density and the spatial vehicle distribution pattern are calculated by this data process/control unit 39, and a predicted traffic flow rate is obtained from the equations (6) and (7) in the data process/control unit 39. Then, the traffic lights signaling system 41 is controlled by using the isolated traffic signal control method according to the second embodiment.

As described above, in accordance with the third embodiment, the spatial vehicle distribution pattern can be obtained by using the video cameras and the simple image processing apparatus, and therefore, the proper control signal without any waste time can be transmitted to the traffic light signaling system based upon the spatial vehicle distribution pattern.

One video camera employed for measuring a scene on a road where the green light is displayed, picks up images of an incoming traffic flow, and then the image processing apparatus judges whether the green time should be extended, or ceased in response to the image data. When the green light signaling is changed to the opposite road, the other video camera starts to pick up images of another incoming traffic flow. A similar control will be continued while the video cameras are switched.

As apparent from the above-explained embodiments, in accordance with the present invention, both of the mean speeds and the traffic flow rates of the vehicles traveled in the road section, which are varied time to time, can be predicted in high precision without any delay.

Moreover, according to the present invention, the interruption of jammed traffic flows can be detected at high precision from the spatial vehicle distribution. The optimum green times can be distributed to the traffic light signaling, so that a traffic jam occurring near an intersection can be effectively solved. Additionally, the initial green time which was conventionally constant, may be varied in accordance with the traffic flow.

Also, according to the present invention, the spatial vehicle distribution can be obtained by employing the video cameras and the simple image processing apparatus, and the control signal for indicating whether or not the present traffic light representation is extended in response to the spatial vehicle distribution, is directly transmitted to the traffic lights signaling system, so that the traffic lights can be properly controlled without any waste time.

We claim:

1. A method for predicting a spatial mean speed and a traffic flow rate, comprising the steps of:

defining a measurement section on a road;

acquiring an image of a vehicle stream within said measurement section;

obtaining spatial vehicle pattern from said image;

calculating a traffic density and a correction coefficient for a distribution pattern of vehicle flow based upon said spatial vehicle pattern; and predicting a spatial mean speed of a group of vehicles traveling on the road and a traffic flow rate on the road based on said traffic density and said correction coefficient, wherein said correction coefficient is equal to a value obtained by dividing a first difference between a current entropy and a minimum possible entropy by a second difference between said minimum possible entropy and a maximum possible entropy, said current entropy being calculated based on a space headway of vehicles within the measurement section when the image is acquired, said minimum possible entropy being a function of a number of said vehicles within the measurement section and being calculated on an assumption that said number of said vehicles are evenly distributed within the measurement section, and said maximum available entropy being a function of said number of said vehicles and being calculated on an assumption that said number of said vehicles are located within a single jammed group in the measurement section.

2. A traffic light controlling method comprising the steps of:

defining a measurement section in a vehicle stream of a road which approaches a traffic light provided on the road, said traffic light having a green light with a green light turn-ON minimum time and a green light turn-ON maximum time which are predetermined for said traffic light;

when the green light of the traffic light is turned ON, acquiring a first image of a portion of said vehicle stream which lies within the measurement section, calculating a number of traveling vehicles from said first image, and modifying said green light turn-ON minimum time based upon the number of traveling vehicles;

after said green light turn-ON minimum time, acquiring a second image of said portion of said vehicle stream which lies within the measurement section, obtaining a spatial vehicle stream pattern from said first and second images, calculating a traffic density and a vehicle stream distribution from said spatial vehicle stream pattern, calculating a correction coefficient based on said traffic density and said vehicle stream distribution, predicting a traffic flow rate of the road based upon said traffic density and said correction coefficient, and, in accordance with said traffic flow rate, (i) turning the green light OFF when said traffic flow rate is smaller than a predetermined threshold value, and (ii) keeping the green light turned ON when said traffic flow rate is greater than said predetermined threshold value; and turning OFF the green light when said green light turn-ON maximum time has passed, wherein said correction coefficient is equal to a value obtained by dividing a first difference between current entropy and a minimum possible entropy by a second difference between said minimum possible entropy and a maximum possible entropy, said current entropy being calculated based on a space headway of vehicles within the measurement section, said minimum possible entropy being a function of a number of vehicles within the measurement section and being calculated on an assumption that said number of vehicles are evenly distributed within the measurement section, said maximum possible entropy being a function of said number of vehicles and being calculated on an assumption that said number of vehicles are located within a single jammed group within the measurement section.

3. A traffic light controlling apparatus for controlling a traffic light signaling system provided on an intersection, comprising:

a video camera for imaging a traffic condition in a vehicle stream approaching said intersection to sequentially produce a first analog video signal related to a first screen and a second analog video signal related to a second screen after a predetermined time interval;

an A/D converter for converting said first analog video signal and said second analog video signal into a first digital image signal and a second digital image signal;

a first image memory for storing therein said first digital image signal;

a second image memory for storing therein said second digital image signal;

image processing means for image-processing said first digital image signal inputted from said first image memory and said second digital image signal inputted from said second image memory to extract at least one traveling vehicle within a measurement section in the image and for producing a third digital image signal representative of said at least one traveling vehicle;

input/output means coupled to said traffic light signaling system, for receiving data of a traffic light condition of said traffic light signaling system; and data process/control means for receiving said data of said traffic light condition from said input/output means and said third digital image signal from said image processing means, for calculating a total number of traveling vehicles within said measurement section and intervals between front ends of adjacent ones of said vehicles in accordance with said data of said traffic light condition and said third digital image signal, for calculating a correction coefficient and a traffic density based upon said total number and said intervals, thereby deriving a predicted traffic flow rate, and for producing a control signal used to control said traffic light signaling system based on said total number of traveling vehicles and said predicted traffic flow rate, said input/output means transferring said control signal to said traffic light signaling system, wherein said correction coefficient is equal to a value obtained by dividing a first difference between a current entropy and a minimum possible entropy by a second difference between said minimum possible entropy and a maximum possible entropy, said current entropy being calculated based on said intervals, said minimum possible entropy being a function of said total number of traveling vehicles and being based on an assumption that said total number of traveling vehicles are evenly distributed within the measurement section, and said maximum possible entropy being a function of said total number of traveling vehicles and being calculated on an assumption that said total number of traveling vehicles are located within a single jammed group within the measurement section.

4. A spatial mean speed/traffic flow rate predicting method as claimed in claim 1, wherein said minimum possible entropy is a function only of said number of said vehicles.

5. A spatial mean speed/traffic flow rate predicting method as claimed in claim 1, wherein said maximum possible entropy is a function only of said number of said vehicles.

6. A traffic light controlling method as claimed in claim 2, wherein said minimum possible entropy is a function only of said number of vehicle.

7. A traffic light controlling method as claimed in claim 2, wherein said maximum possible entropy is a function only of said number of vehicle.

8. A traffic light controlling apparatus as claimed in claim 3, wherein said minimum possible entropy is a function only of said total number of traveling vehicles.

9. A traffic light controlling apparatus as claimed in claim 3, wherein said maximum possible entropy is a function only of said total number of traveling vehicles.

* * * * *